US008458944B2

(12) United States Patent
Houde-Walter

(10) Patent No.: US 8,458,944 B2
(45) **Date of Patent: *Jun. 11, 2013**

(54) FIREARM ASSEMBLY

(75) Inventor: William R. Houde-Walter, Rush, NY (US)

(73) Assignee: LaserMax, Inc., Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/555,883

(22) Filed: Jul. 23, 2012

(65) Prior Publication Data

US 2012/0285064 A1 Nov. 15, 2012

Related U.S. Application Data

(63) Continuation of application No. 12/504,462, filed on Jul. 16, 2006, now Pat. No. 8,225,542.

(60) Provisional application No. 61/081,278, filed on Jul. 16, 2008.

(51) Int. Cl.
*F41C 23/12* (2006.01)
*F41C 23/16* (2006.01)
*F41A 35/00* (2006.01)

(52) U.S. Cl.
USPC ..... 42/72; 42/84

(58) Field of Classification Search
USPC ..... 42/84, 71.01, 71.02, 72
See application file for complete search history.

(56) References Cited

U.S. PATENT DOCUMENTS 2,957,391 A 4/1955 Lovercheck
3,075,433 A * 1/1963 Stockholm ..... 89/13.05
4,617,750 A * 10/1986 Garehime, Jr. ..... 42/65
4,869,008 A * 9/1989 Rasmussen ..... 42/71.01
4,970,819 A 11/1990 Mayhak
5,345,231 A * 9/1994 Koo et al. ..... 340/870.31
5,481,819 A 1/1996 Teetzel
5,584,137 A 12/1996 Teetzel
5,669,174 A * 9/1997 Teetzel ..... 42/115
5,755,056 A 5/1998 Danner
5,822,905 A 10/1998 Teetzel
5,824,942 A * 10/1998 Mladjan et al. ..... 89/41.17
5,941,489 A 8/1999 Fanelli et al.
6,269,728 B1 8/2001 Kern
6,519,083 B2 * 2/2003 Heinrich ..... 359/422
6,813,025 B2 * 11/2004 Edwards ..... 356/422
6,931,775 B2 * 8/2005 Burnett ..... 42/72
7,818,910 B2 10/2010 Young
8,225,542 B2 * 7/2012 Houde-Walter ..... 42/72
2003/0163943 A1 * 9/2003 Holmberg ..... 42/142
2006/0277809 A1 12/2006 Moody
2007/0157502 A1 * 7/2007 Holmberg ..... 42/124
2007/0199225 A1 8/2007 Haugen
2007/0214698 A1 * 9/2007 Hung et al. ..... 42/111
2009/0108589 A1 4/2009 Racho
2010/0031552 A1 2/2010 Houde-Walter

OTHER PUBLICATIONS

The Firearm Blog website (5 pages) (http://www.thefirearmblog.com/blog/2009/06/15/goodbye-picatinny-hello-nato-accessory.

* cited by examiner

*Primary Examiner* — Bret Hayes
(74) *Attorney, Agent, or Firm* — Finnegan, Henderson, Farabow, Garrett & Dunner LLP

(57) ABSTRACT

A firearm system includes a foregrip removably mountable to a firearm, the foregrip having a programmable button controlling at least one of an accessory of the firearm and a component of the foregrip.

26 Claims, 5 Drawing Sheets

FIREARM ASSEMBLY

CROSS-REFERENCE TO RELATED APPLICATIONS

This application is a continuation of, and claims priority to, U.S. application Ser. No. 12/504,462, filed Jul. 16, 2009 now U.S. Pat. No. 8,225,542, which claims priority to U.S. Provisional Patent Application 61/081,278, filed Jul. 16, 2008. Each of the above-referenced applications is expressly incorporated by reference herein in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING"

Not applicable.

BACKGROUND OF THE INVENTION

1. Field of the Invention

The invention relates to rail mounted assemblies for firearms and, more particularly, to firearm assemblies and/or accessories configured with control surfaces, communication capabilities, and/or power generation capabilities.

2. Background of the Invention

Firearms can be used for a variety of purposes such as, for example, hunting, self-defense, law enforcement, and military activities. As such applications for firearms vary, so too do the different accessories capable of being utilized with the firearm. In particular, each such activity may lend itself and/or otherwise require one or more accessories configured to increase the utility of the firearm. For example, in law-enforcement applications, firearms are often fitted with lights and/or other accessories configured to assist in warning criminals of the presence of a law enforcement officer. In such applications, firearms utilized by law enforcement officers may also be fitted with one or more laser sights configured to assist the officer in aiming the firearm. Such accessories are well known in the art and require relatively basic mounting structures and control functionality.

However, as contemporary firearm technology continues to develop and evolve, so does the need for more sophisticated control, data transfer, power generation, and networking functionality configured for use with the firearm and the accessories. For example, many contemporary accessories designed for use with firearms may require a power source. Such power sources, however, may be bulky and heavy, and may make it more difficult to utilize the firearm as intended. This may be particularly true in applications where the firearm and it's powered accessory are utilized in remote locations for extended periods of time. As another example, some contemporary firearm accessories may be configured for, for example, data sharing, networking, and/or communication with other firearm accessories locally or remotely. Such accessories may also be configured to communicate with, for example, a remote central command center. Each of these accessories, however, may have its own separate set of controls. Such controls may be difficult for a firearm user to manipulate, particularly, while using the firearm for its intended purpose. For example, the controls of such accessories may require the use of both hands, may not be positioned in a way that makes it easy for the firearm user to adjust them, and/or may require extensive manipulation by the user. Such ergonomic and design deficiencies make the repeated use of such controls tedious. It is understood that the difficulties associated with operating such controls are compounded when two or more accessories are connected to the firearm for use.

Accordingly, the systems and methods of the present disclosure are directed towards overcoming one or more of the above deficiencies.

2. Description of Related Art

None.

BRIEF SUMMARY OF THE INVENTION

In an exemplary embodiment of the present disclosure, a firearm system includes a foregrip removably mountable to a firearm, the foregrip having a programmable button controlling at least one of an accessory of the firearm and a component of the foregrip.

In another exemplary embodiment of the present disclosure, a firearm system includes a first accessory mounted to a firearm and a second accessory mounted to the firearm, the first and second accessories transmitting information therebetween. The system also includes a foregrip removably mounted to the firearm, the foregrip having a programmable button controllably connected to at least one of the first and second accessories.

In still another exemplary embodiment of the present disclosure, a firearm system includes a first accessory mounted to a firearm and a second accessory mounted to the firearm, the first and second accessories transmitting information therebetween. The system also includes a foregrip removably mounted to the firearm, the foregrip having a programmable button controllably connected to at least one of the first and second accessories. The system further includes a power generator providing power to the first and second accessories.

In yet another exemplary embodiment of the present disclosure, a method of controlling a firearm system includes removably connecting a foregrip to a firearm and directing a control signal from the foregrip to an accessory of the firearm by manipulating a programmable button of the foregrip.

In a further exemplary embodiment of the present disclosure, a firearm system includes an accessory connected to a firearm, the accessory configured to perform a first function, and a foregrip removably connected to the firearm. The foregrip includes a button programmable to effect performance of the first function in response to actuation of the button.

In still another exemplary embodiment of the present disclosure, a firearm system includes a loading bolt disposed within a firearm, an induction coil disposed proximate the loading bolt, and a rechargeable power source electrically connected to at least one of the loading bolt and the induction coil such that relative movement between the loading bolt and the induction coil directs power to the rechargeable power source.

In a further exemplary embodiment of the present disclosure, a method of controlling a firearm system includes inducing relative motion between a loading bolt of a firearm and an induction coil disposed proximate the loading bolt, wherein the relative motion generates power. The method also includes directing the generated power to a rechargeable power source, and energizing a rail engaging the firearm and electrically connected to the rechargeable power source with power stored in the rechargeable power source.

In another exemplary embodiment of the present disclosure, a firearm includes a frame, and a bolt movably connected to the frame between a first position and a second position. The firearm also includes one of an electrically conductive coil and a magnet connected to the bolt and moveable with the bolt, and a remaining one of the electrically conductive coil and the magnet connected to the frame. The firearm further includes a resistive load electrically connected to the induction coil.

In still another exemplary embodiment of the present disclosure, a method of operating a firearm includes connecting one of an electrically conductive coil and a magnet to a bolt, connecting a remaining one of the electrically conductive coil and the magnet to a frame of the firearm, and moving the bolt relative to the frame to create an electrical current in the electrically conductive coil.

BRIEF DESCRIPTION OF THE SEVERAL VIEWS OF THE DRAWING(S)

Figure 5:
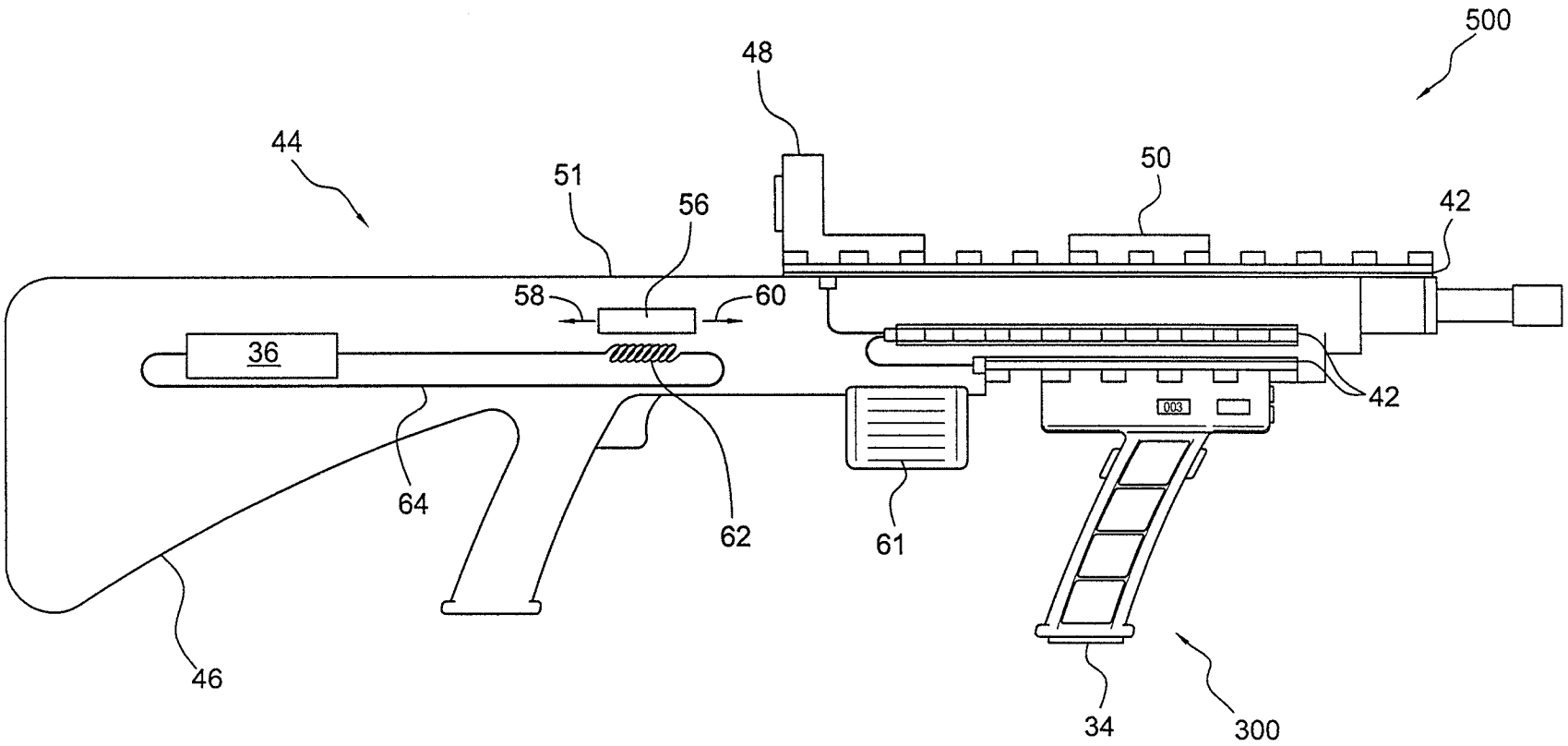

FIG. 5 a partial schematic view of a firearm system according to another exemplary embodiment of the present disclosure.

Figure 6:
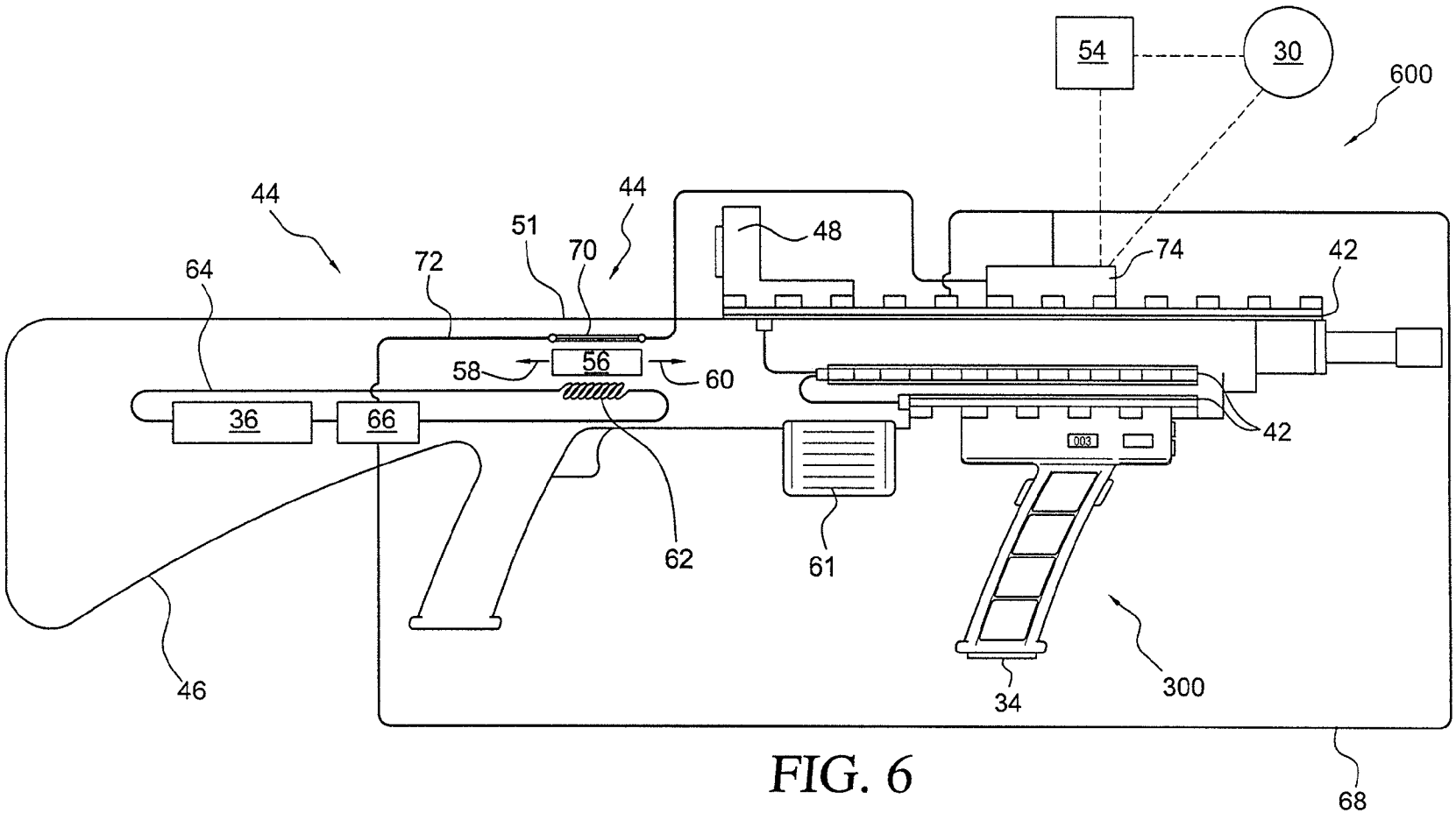

FIG. 6 a partial schematic view of a firearm system according to a further exemplary embodiment of the present disclosure.

DETAILED DESCRIPTION OF THE INVENTION

Figure 1:
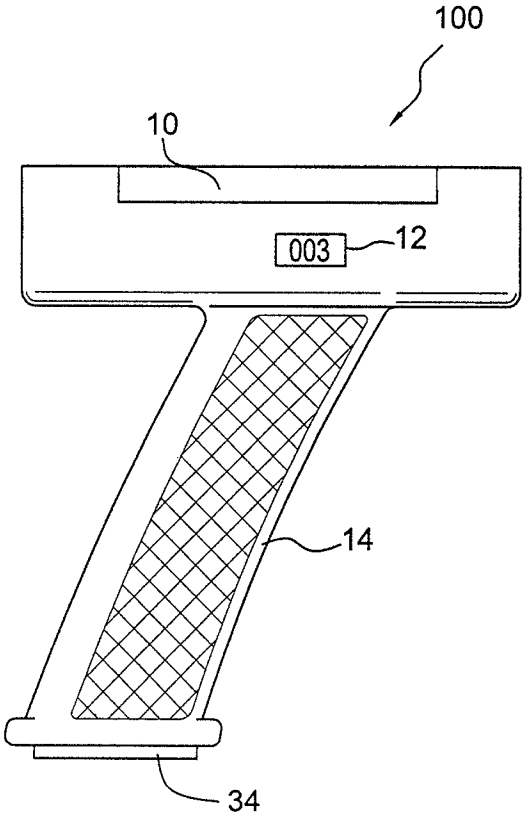
FIG. 1 is a side view of a foregrip according to an exemplary embodiment of the present disclosure.

FIG. 1 illustrates a foregrip 100 according to an exemplary embodiment of the present disclosure. As shown in FIG. 1, a foregrip 100 may include, for example, a housing 14 defining a mount 10. The foregrip 100 may also include an event counter 12 and a power source 34. The housing 14 may be made from any material known in the art such as, for example, metals and/or alloys thereof. The mount 10 may be any mechanical mounting structure configured to rigidly connect the housing 14 to, for example, a frame or other portion of a firearm. The firearm may be, for example, a rifle, machine gun, and/or any other automatic or semi automatic firearm known in the art. In an exemplary embodiment, the mount 10 may mechanically couple and/or electrically connect the foregrip 100 to a rail 42 of the firearm.

The power source 34 can be any source of power known in the art such as, for example, one or more batteries. In an exemplary embodiment of the present disclosure, the power source 34 may comprise a plurality of AA batteries. In additional exemplary embodiments, the power source 34 may comprise a DL-123. It is understood that in the power source 34 may be rechargeable, and may be electrically connected to components of the foregrip 100 via a known electrical connection means. For example, the power source 34 may be electrically connected to the event counter 12 so as to provide power thereto. It is also understood that the foregrip 100 may define a power source compartment (not shown) sized and/or otherwise configured to receive and/or otherwise store at least a portion of the power source 34.

The event counter 12 may be, for example, any counting mechanism known in the art configured for use with a firearm. In an exemplary embodiment, the event counter 12 may comprise an accelerometer-based shot counter configured to count and/or otherwise keep track of the number of bullets, lasers, and/or other projectiles fired by the firearm to which the foregrip 100 is attached. The event counter 12 may also keep track of the number of rounds of ammunition remaining in a magazine of the firearm. The event counter 12 may be configured to provide any of the above information to the user. In an exemplary embodiment, the event counter 12 may comprise a magnet assembly configured to generate a current through, for example, the Faraday effect and/or other known electrical circuit principles. The event counter 12 may be electrically connected to, for example, a microprocessor configured to evaluate the current and/or signal generated by the event counter 12. The microprocessor and/or the event counter 12 itself may be configured to determine whether a firing event has occurred based on the generated currents. In addition, the microprocessor and/or the event counter 12 may be configured to distinguish between, for example, a shot being fired by the firearms, and other non-qualifying events such as, for example, erratic movements of the firearm, dropping the firearm, contacting the firearm with one or more substantially rigid objects, removing the firearm from a case in which it is disposed, and/or other common motion-based activities.

In another exemplary embodiment, the event counter 12 may be a capacitor-based shot counter. In such an exemplary embodiment, the event counter 12 may function to generate a current and distinguish between a firing event and a non-firing event in much the same way as the accelerator based event counter 12 discussed above. And in still other exemplary embodiments, the event counter 12 may comprise a microphone based shot counter. Such a shot counter may generate a voltage based on the optics observed thereby, and may be configured to distinguish between a voltage generated during a firing event and one of the exemplary non-qualifying events discussed above. In such an exemplary embodiment, the energy generated by the even counter 12 may be directed to and stored by the power source 34. In yet another exemplary embodiment, the event counter 12 may comprise an optical shot counter configured to detect changes in the intensity of a light source disposed therein due to vibrations caused when the firearm to which the foregrip 100 is connected to is fired.

Figure 2:
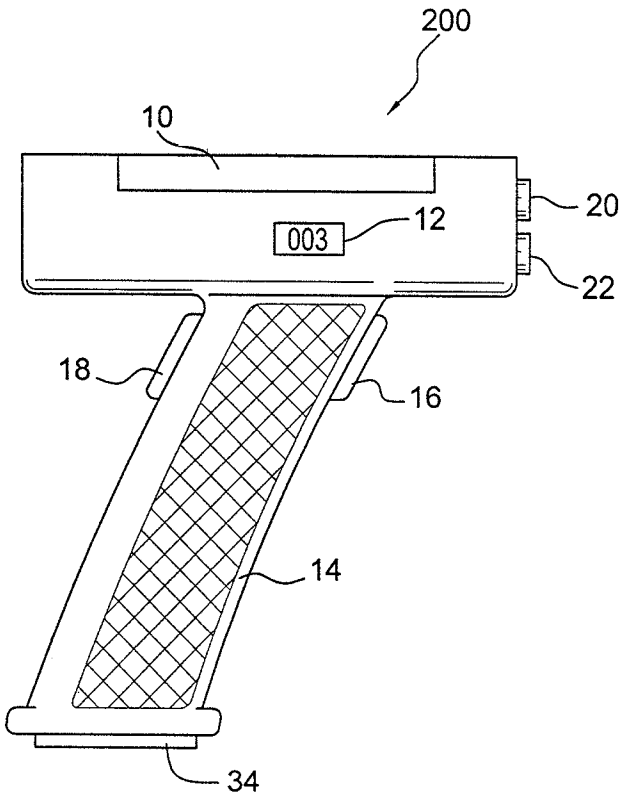
FIG. 2 is a side view of a foregrip according to another exemplary embodiment of the present disclosure.

As shown in FIG. 2, in another exemplary embodiment of the present disclosure, a foregrip 200 may include, for example, a selection device 18, an activation device 16, a first light source 20, and a second light source 22. It is understood that, throughout the duration of the present disclosure, like components of the systems and structures described herein will be described using like numerals unless otherwise specified. The light sources 20, 22 can comprise, for example, any of a variety of known lasers or lights. Typically, the light sources 20, 22 are self-contained and include lenses. The light sources 20, 22 can comprise, for example, any combination of a green laser, a red laser, an infrared laser, a white and colored LED, a class 3A laser having an output of less than 5 mW, a guide light, a warning laser, a communication laser, and/or any other type of lights or laser known in the military, defense, law enforcement, or illumination industries. For example, the light sources 20, 22 may comprise either a laser or a light configured for use in illumination, warning, gaming, communications, and/or signaling. The light sources 20, 22 can also comprise a laser capable of friend or foe data encoding.

The selection device 18 illustrated in FIG. 2 may comprise, for example, a switch, button, and/or any other known structure or assembly configured to assist in selecting one or more system components for use. The selection device 18 may be mounted to the foregrip 200 such that the device 18 can be actuated by a finger of the user. In an exemplary embodiment, the selection device 18 may be disposed at a back end of the foregrip 200 to enable manipulation by a thumb of the user. The selection device 18 can be configured to enable the user to select which of the light sources 20, 22 will be energized upon manipulation of the activation device 16. For example, the selection device 18 can be a switch configured to be manipulated so as to allow activation of either the first light source 20 or the second light source 22, or both light sources 20, 22 at the same time. It is understood that the selection device 18 may have two or more position settings to facilitate such selection.

The activation device 16 of the foregrip 200 may be disposed at a front end of the foregrip 200 to enable manipulation by, for example, a forefinger of the user. The activation device 16 may be, for example, a button, a switch, and/or any other mechanism configured to energize and/or otherwise activate a component of an assembly. For example, the activation device 16 may be similar to a trigger for a depressible switch configured to activate the one or more light sources 20, 22 selected for use.

Figure 3:
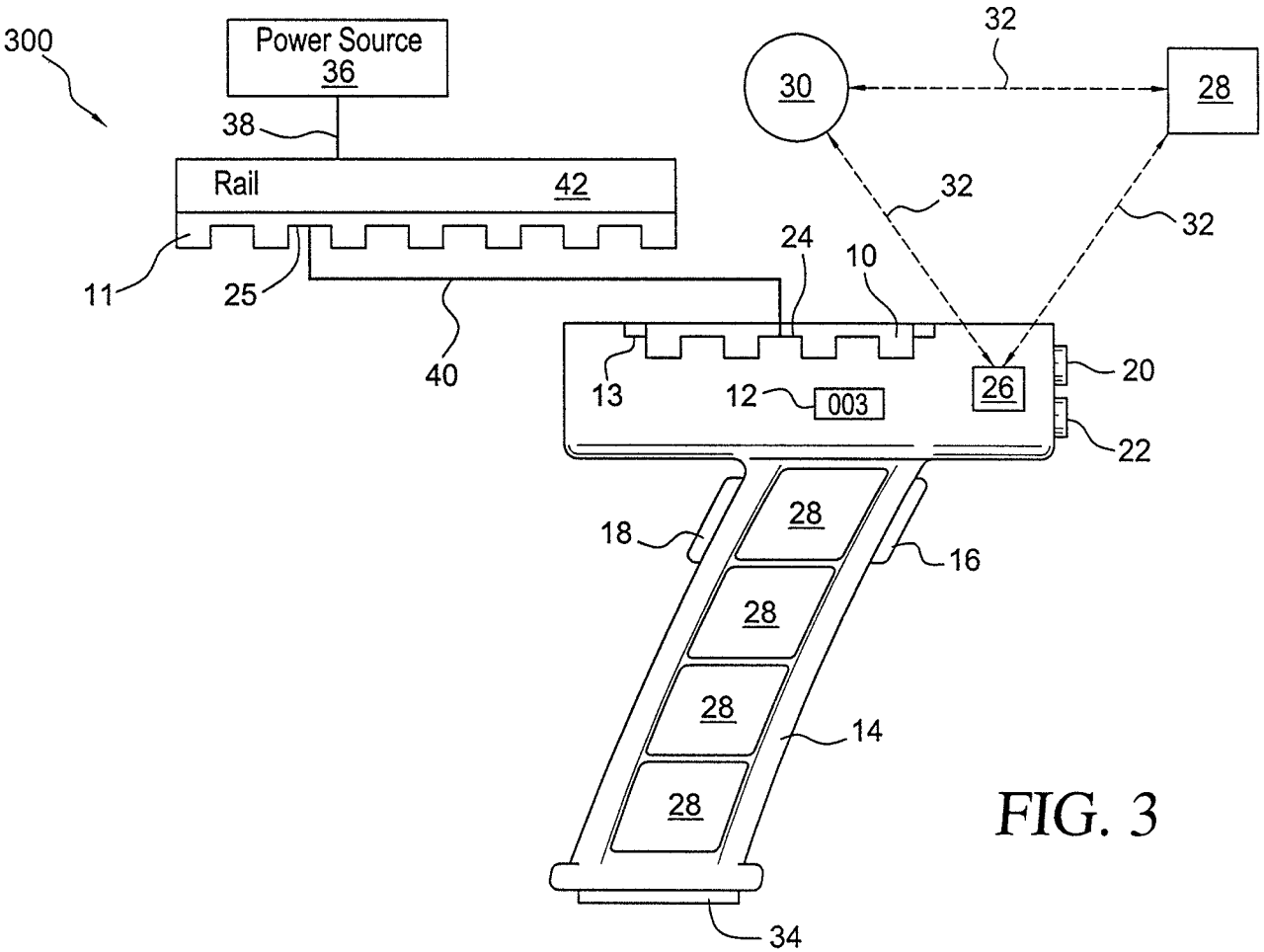
FIG. 3 is a side view of a foregrip according to a further exemplary embodiment of the present disclosure.

As shown in FIG. 3, an exemplary foregrip 300 of the present disclosure may also comprise one or more programmable buttons 28. The programmable buttons 28 may be, for example, mechanically similar to the selection and/or activation devices 18, 16 discussed above. In addition, the programmable buttons 28 may be programmed to control one or more components of the foregrip 300 and/or one or more components or accessories connected to the firearm to which the foregrip 300 is mounted. For example, the programmable buttons 28 may be selected either individually or in combination to control one or more operations of an accessory connected to the firearm. As will be discussed in greater detail below, such an accessory may be electrically connected and/or mechanically coupled to a rail 42 of the firearm. As shown in FIG. 3, the foregrip 300 may also be connected to the rail 42 via the USB port 24 and a connection 40. Accordingly, selecting and/or otherwise manipulating one or more of the programmable buttons 28 may enable the user to at least partially control the firearm accessory through the joint connectivity to the rail 42. Alternatively, the foregrip 300 may be connected to a first rail 42 of the firearm and one or more accessories may be connected to other additional rails of the firearm. In such an additional exemplary embodiment, the programmable buttons 38 may enable control of the accessories through electrical connectivity between the rails 42 of the firearm, the foregrip 300, and/or the accessories.

As mentioned above, the buttons 28 are programmable and, thus, each of the programmable buttons 28 may be programmed to control a unique function and/or operation of the accessory connected to the rail 42 and/or to control one or more functions or operations of the various components of the foregrip 300. It is understood that actuating two or more programmable buttons 28 at a time may give the user the ability to control additional functionality of such accessories or components. Although not illustrated in FIG. 3, it is understood that each of the programmable buttons 28 may be connected to a microprocessor disposed within the foregrip 300. The microprocessor may be configured to assist in programming the functionality of the one or more programmable buttons 28. The microprocessor may also be configured to assist in controlling the one or more accessories or components discussed above.

The port 24 may be any standard connection port known in the art such as, for example, a standard USB connection port or a standard FireWire port. The port 24 and the connection 40 may facilitate data and/or power connectivity between the foregrip 300 and the rail 42. For example, power may be transmitted from the rail 42 to the foregrip 300, or from the power source 34 of the foregrip 300, to the rail 42 via the port 24. In an exemplary embodiment, the port 24 may be electrically and/or mechanically connected to a compatible port 25 of the rail 42. For example, the mount 10 of the foregrip 300 may mate with a corresponding mount 11 of the rail 42 to facilitate a removable mechanical connection or coupling between the foregrip 300 and the rail 42. One or more locks 13 or other like devices may also be employed to fortify this connection. While so coupled, the port 24 of the foregrip 300 may also be electrically connected to the port 25 of the rail 42 to facilitate the transfer of data and/or power therebetween. Also, although FIG. 3 illustrates the port 24 as being part of and/or embedded within the mount and the port 25 as being part of and/or embedded within the mount 11, in additional exemplary embodiments, at least one of the ports 24, 25 may be separate from its respective mount 10, 11. It is also understood that the connection 40, shown schematically in FIG. 3, may be, for example, a hardwired electrical connection, and/or any other data and/or power connection known in the art.

The rail 42 may be any conventional accessory mount such as, for example, a Picatinny rail. Such rails 42 may be configured to enable accessories such as laser sights, rangefinders, and/or other known accessories to be connected and/or removed to a firearm quickly, and with as little adjustment as possible. The port 25 of the rail 42 may also include a plurality of USB connections configured to facilitate the transfer of data and/or power between components of the firearm such as, for example, the foregrips 100, 200, 300 described herein and accessories connected to the rail 42. In an exemplary embodiment, the rail 42 may comprise a standard Picatinny rail having two data lines, a positive terminal, and a negative terminal. In an additional exemplary embodiment, the rail 42 may comprise a plurality of USB connections and the firearm may comprise two or more rails 42 desirably positioned thereon.

The rail 42 may be electrically connected to a power source 36 via a connection 38. In the connection 38 may be substantially similar to the connection 40 discussed above. The power source 36 may comprise, for example, a rechargeable battery and/or other known power storage devices. In an exemplary embodiment, the power source 36 may comprise a lithium sulfur rechargeable battery. The power source 36 may be configured to provide power to each of the accessories connected to the rail 42 and may also be configured to provide power to, for example, a first and second light sources 20, 22 and/or any other components of the foregrip 300. It is also understood that, in an additional exemplary embodiment, the power source 34 of the foregrip 300 may be configured to provide power to any of the accessories connected to the rail 42 via the USB connection discussed above. As will be discussed in greater detail below, a bolt and/or other components of the firearm to which the foregrip 300 is connected may be configured to recharge and/or otherwise provide power to the power source 36 during one or more firing events.

In still another exemplary embodiment of the present disclosure, the rail 42 may include one or more inductive coupling devices. For example, one or more of the ports 25 may include a first portion of an inductive coupling device and one or more corresponding ports 24 of the foregrip 300, or of an accessory connected to the rail 42, may include a second mating portion of the inductive coupling device. The inductive coupling device may be configured to transmit data and/or power between, for example, the rail 42, and the foregrip 300 or accessory connected thereto. In an exemplary embodiment, the inductive coupling device may be an inductive power coupling device in which the first portion included in the one or more ports 25 may comprise a first portion of an inductor/transmitter, and the second portion included in either the foregrip 300 or the accessory comprises a mating second portion of the inductor/transmitter.

In another exemplary embodiment, the rail 42 may include one or more optical data links. The optical data link may comprise an optical transmitter/receiver, and such an optical transmitter/receiver may include, for example, a photodiode and a corresponding receptor or photodetector. As in the inductive coupling device embodiments discussed above, in an embodiment in which the rail 42 comprises an optical data link, a transmitter portion of the optical data link may reside in one or more ports 25 of the rail 42 while a receiver portion of the optical data link may reside in one or more ports 24 of the foregrip 300 or accessory coupled to the rail 42.

It is understood that, both power and data may be transmitted via a single inductive coupling device or via a single optical data link. Alternatively, power and data may be transmitted, for example, between the rail 42, and either the foregrip 300 or the accessory, via separate inductive coupling devices or via separate optical data links. The inductive coupling devices and the optical data links may be fluidly, and/or otherwise sealed from the environment or surroundings in which the firearm is used once the foregrip 300 and/or the accessory is connected to the rail 42. Thus, the inductive coupling devices and the optical data links may comprise sealed components of the firearm assembly through which power and/or data is transmitted. It is also understood that data and/or power may be transmitted to or from the inductive coupling devices and the optical data links.

As shown in FIG. 3, the foregrip 300 may also include an RF transmitter 26. The RF transmitter 26 may be, for example, any known source of standard radio frequency emissions known in the art. An exemplary embodiment, the RF transmitter 26 may be configured to activate one or more remote devices that are not connected to the rail 42. As shown in FIG. 3, in an exemplary embodiment, the RF transmitter 26 may be connected to one or more remote receiver/senders 28 via a wireless connection 32. The wireless connection 32 may be, for example, a WiFi connection, a radio frequency transmission, and/or any other known wireless connection. The RF transmitter 26 may enable a wide range of communications between users of the firearm and remote or local receiver/senders 28. For example, the receiver/sender 28 may comprise a remote access switch, sensor, a light, explosives, distraction device, alarm, and/or any other device capable of receiving a radio frequency emission and activating upon receipt of such an emission. In such an exemplary embodiment, a user of the foregrip 300 may activate the receiver/sender 28 by initiating communication there with through the RF transmitter 26. It is understood that any one or more of the programmable buttons 28 may be utilized by the user to activate the RF transmitter 26. In an additional exemplary embodiment, the RF transmitter 26 may comprise a friend or foe indicator, an assistance beacon, a signaling device, a paging device, a warning indicator, and/or any other known indication device. In such exemplary embodiments, the RF transmitter 26 may, itself, provide an indication and/or signal to the user of the foregrip 300. Alternatively, the RF transmitter 26 may send a signal to one or more accessories connected to the rail 42 to notify the user of information received by the RF transmitter 26. Such information may be, for example, video, data, and/or other information known in the art.

The sender/receiver 28 and the RF transmitter 26 may be connected to one or more devices 30 configured to assist in transmitting signals and/or other information between remote locations. For example, the device 30 may comprise one or more repeaters known in the arts. Such repeaters may be configured to send and resend a radio signal transmitted by the RF transmitter 26 to a remote location at one or more different frequencies. In addition, the device 30 may comprise one or more satellites configured to transmit one or more signals emitted by the RF transmitter 26 across great distances. It is understood, that the connections 32 described herein between the RF transmitter 26, the devices 30, and the receiver/sender 28 generally facilitates a broad range of networking and/or connectivity between the user of the foregrip 300 and other remote senders/receivers of data or information. Such connectivity may be extremely useful to users of, for example, the foregrip 300 and a variety of military, law enforcement, self defense, and/or other known applications.

Figure 4:
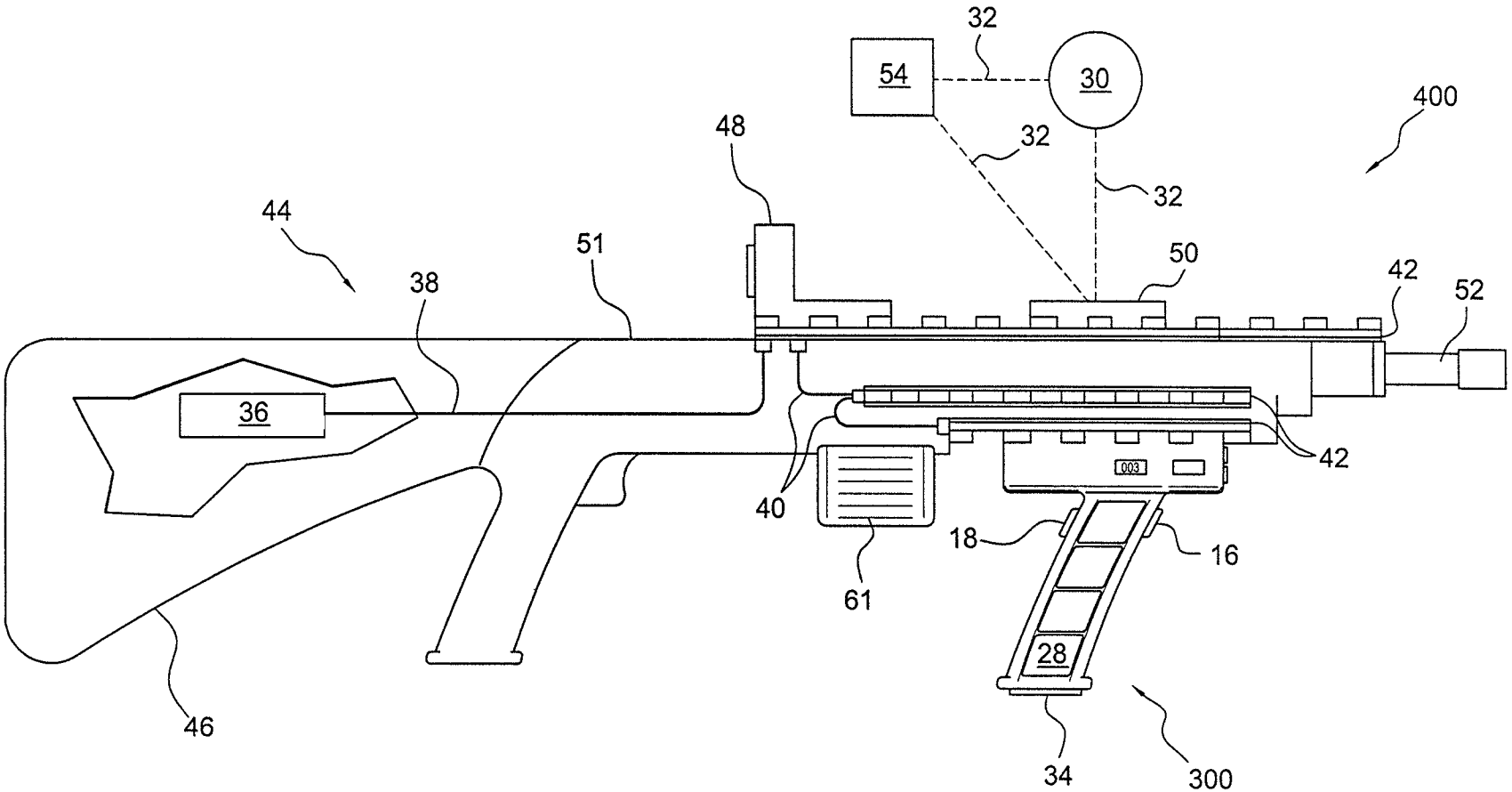
FIG. 4 is a partial schematic view of a firearm system according to an exemplary embodiment of the present disclosure.

FIG. 4 illustrates a partial schematic view of a firearm system 400 according to an exemplary embodiment of the present disclosure. It is understood that such a system 400 may include any of the foregrips 100, 200, 300 described above. However, the foregrip 300 is illustrated in FIGS. 4-6 for ease of description. FIG. 4 illustrates a firearm 44 comprising a frame 51, a barrel 52, a foregrip 300, a magazine 61, and a butt stock 46. The frame 51, barrel 52, magazine 61, and butt stock 46 may be substantially similar to frames, barrels, magazines, and butt stocks known in the art. Accordingly, these components will not be discussed in great detail herein.

The firearm 44 described herein is intended to encompass any of a variety of hand held or portable projectile or laser launching devices. The firearm 44 can be, for example, a rifle, a shotgun, a machine gun, or other like gun, and can be gas-actuated, inertia-actuated, semiautomatic, pump action and bolt action. In an exemplary embodiment, one or more rails 42 may be mounted proximate to and/or along at least a portion of the barrel 52.

Various accessories 50 can be mounted to the one or more rails 42 including tactical lights, laser sight modules, supporting devices, stand alone in-line clip-on night vision systems, optical scopes, target pointer/illuminators (TPIAL) such as Mil Spec AN/PEQ-2 or AN/PEQ-4, white light illumination devices, LCD displays, laser lights, rangefinders, global positioning systems, satellite links, PC controllers, and/or other known firearm accessories. As discussed above, such accessories may be physically mounted to rail 42 and may also be electrically connected to the rail 42. In an exemplary embodiment, the one or more accessories 50 may comprise one or more additional lasers and/or lights such as, for example, a thermal laser, a relatively bright distracting white, and/or other known whites or lasers. It is understood that, due to the data, power, and/or other connections between the accessories 50 and the rail 42, many of the accessories 50 may be controlled using the one or more programmable buttons 28 of the foregrip 300.

In addition, the one or more accessories 50 may be configured to transmit information between one another. For example, as shown in FIG. 4, an accessory 50 and a head-up display 48 may both be connected to a single rail 42. In such an exemplary embodiment, the accessory 50 may comprise a rangefinder configured to send signals and/or other information to the head up display 48. In particular, the rangefinder 50 may communicate with a computer and/or microprocessor (not shown) connected to the rail 42 and may transmit range information to the computer. The computer may also be connected to a global positioning system via the rail 42. In such an exemplary embodiment, the computer may receive trajectory and/or point of contact information from the rangefinder, and may receive target positioning information from the global positioning system. The computer may then process these two separate sets of information and may transmit a modified information signal to the head-up display 48 containing such target information. It is understood that head-up display 48 may comprise an LCD and/or other known display screen, and the head-up display 48 may be configured to display real-time video and/or aiming or point of impact information to the user. Thus, in such an exemplary embodiment, the head-up display 48 may be configured to display both the modified information received from the computer, and real-time target, crosshair, and/or other video information, to a user at the same time.

As shown in FIG. 4, the accessories 50 may also be connected to one or more receiver/senders 54 via a wireless connection 32. It is understood that, in an exemplary embodiment, the receiver/senders 54 may be substantially similar to the receiver/senders 28 discussed above with respect to FIG. 3.

As shown in FIG. 5, in an additional exemplary embodiment of the present disclosure, a firearm system 500 may include one or more power generating mechanisms configured to provide electrical power to the accessories 50 and/or to the foregrip 300 connected to the one or more rails 42 via the USB connections discussed above. The firearm 44 may include, for example, a bolt 56 movably connected to the frame 51 between at least a first position and a second position. Through such movement, the bolt 56 may be configured to load one or more ammunition cartridges from the magazine 61 into a chamber of the firearm 44. For example, the bolt 56 may be configured to retract in the direction of arrow 58 thereby enabling the movement of a spring-loaded ammunition cartridge into a pre-chamber. The bolt 56 may also be configured to move in the direction of arrow 62 to transition and/or otherwise move the live round of ammunition from the pre-chamber into the firing chamber of the firearm 44.

The bolt 56 may be, for example, any known loading bolt utilized in conventional firearms. In an exemplary embodiment, the bolt 56 may be made of metal and, in particular, an exemplary bolt 56 may comprise one or more magnetic metals. In still another exemplary embodiment, the bolt 56 may include one or more permanent magnets disposed therein and/or otherwise connected thereto. In yet another exemplary embodiment, the bolt 56 may include an electrically conductive coil, such as an induction coil, disposed therein and/or otherwise connected thereto. In such embodiments, one of the coil and the magnets may be moveable with the bolt 56, while a remaining one of the coil and the magnets may be fixedly connected to the frame 51.

For example, the firearm 44 may include an induction coil 62 disposed proximate the bolt 56. In an exemplary embodiment, the induction coil 62 may substantially surround the bolt 56. The induction coil 62 may be electrically connected to the power source 36 via one or more connections 64. The connections 64 may be substantially similar to the connections 38, 40 discussed above. With the arrangement illustrated in FIG. 5, it is understood that the reciprocating motion of the bolt 56 proximate to the coil 62 and relative to the frame 51 may assist in generating and/or otherwise creating an electrical current in the coil 62 through known Faraday principles. Thus, in an exemplary embodiment, as the firearm 44 is fired and the bolt 56 cycles in the direction of arrows 58, 60, power may be extracted by the Faraday effect of the moving magnetic bolt 56 and the coil 62 mounted proximate to and/or substantially around the bolt 56. In such a configuration, the bolt 56 and the coil 62 can act as a power generator supplying power to the power source 36. In such a configuration, the power source 36 may comprise one or more rechargeable batteries, and firing the firearm 44 may assist in recharging the power source 36. In addition, in such a configuration, the bolt 56 may comprise one or more permanent magnets or, alternatively, the bolt 56 may comprise an inherently magnetic material.

In addition, as illustrated in FIG. 6, the bolt 56 can be configured to act as a linear motor configured to eject a spent cartridge from the chamber, reload a fresh cartridge into the chamber, and lock the chamber for firing. In such an exemplary embodiment, the position of the bolt 56 can be controlled by a driver control circuit configured to retract the bolt 56 in the direction of arrow 58 and to advance the bolt 56 in the direction of the arrow 60. In addition, in such an exemplary embodiment, the bolt 56 may include an electromagnetic coil disposed therein and configured to assist in inducing movements of the bolt 56 relative to the coil 62 upon energizing the coil 62.

The position of the bolt 56 within the firearm 44 may be sensed, monitored, and/or otherwise determined by using one or more position indicators 70. Such position indicators 70 may include, for example, one or more sensors, limit switches, and/or encoders known in the art. The position of the bolt 56 may be monitored by such position indicators 70, and information regarding the position of the bolt 56 may be sent to one or more accessories connected to the rail 42 such as, for example, a computer 74. If the computer 74 determines that the bolt 56 is, for example, out of position due to a cartridge jam or other malfunction, the computer 74 may direct the servo controller 66 connected to the coil 62 to energize the coil 62, thereby displacing the bolt 56 and clearing the jam. In such an exemplary embodiment, the position indicator 70 may comprise a linear scale base displacement encoder and an encoder read head may be mounted to the bolt 56. Accordingly, the bolt 56 may be moved in either the direction of arrow 58 or the direction of arrow 60 based on feedback received by the computer 74, and such movements may be powered by energy stored within the power source 56. It is understood that the servo controller 66 illustrated in FIG. 6 may be any known electromagnetic controller configured to direct, for example, a voltage and/or a current within an electrical circuit. The servo controller 66 may be electrically connected to the computer 74 and/or the rail 42 via the connection 68, and the connection 68 may be substantially similar to the connection 38, 40 discussed above. In addition, the position indicator 70 may be connected to the servo controller 66 and/or the computer 74 via a similar connection.

In an exemplary embodiment of the present disclosure, the firearm systems described herein may be used as a means of controlling a multitude of accessories mechanically and/or electrically connected to a firearm. Such control may be facilitated by, for example, the one or more programmable buttons 28 included on the exemplary foregrip 300 described herein. Such buttons 28 may be configured to control not only components of the foregrip 300 but also to control a multitude of accessories 50 connected to the rail 42 of the firearm 44. Power for the rail 42 may be delivered thereto by the power source 36, and the power source 36 may be rechargeable by cycling the bolt 56 of the firearm 44. In addition, the power source 36, in conjunction with other electrical circuit components, may be utilized to control the position of the bolt 56 within and/or relative to a chamber of the firearm 44.

While the foregoing has described what are considered to be exemplary embodiments of the present disclosure, it is understood that various modifications may be made here to hand them the embodiments described herein may be implemented in various forms and numerous other applications, only some of which have been described herein. It is intended that all such modifications and variations be deemed to fall within the true scope of the following claims.

The invention claimed is:

1. A firearm system, comprising:

a foregrip removably mountable to a firearm, the foregrip having a programmable button controlling at least one of an accessory of the firearm and a component of the foregrip, wherein one of the foregrip and the accessory comprises a first portion of an optical data link, and a rail of the firearm comprises a second portion of the optical data link, the first portion configured to mate with the second portion.

2. The system of claim 1, wherein the further including an additional device wirelessly connected to at least one of the foregrip and the accessory, the additional device being located remote from the firearm.

3. The system of claim 2, wherein the at least one of the foregrip and the accessory transmits an emission to the additional device and the additional device activates upon receipt of the emission.

4. The system of claim 3, wherein the emission comprises a radio frequency.

5. The system of claim 3, the foregrip further comprising a transmitter controllably connected to the programmable button, wherein the emission is sent by the transmitter.

6. A firearm system, comprising:

(a) a first accessory mounted to a firearm;

(b) a second accessory mounted to the firearm, the first and second accessories transmitting information between the accessories;

(c) a foregrip removably mounted to the firearm, the foregrip having a programmable button controllably connected to at least one of the first and second accessories; and (d) an optical data link, a first portion of the optical data link connected to the firearm and a second portion of the optical data link connected to the first accessory, the first portion being configured to mate with the second portion.

7. The system of claim 6, wherein the first portion of the optical data link comprises a transmitter portion and the second portion of the optical data link comprises a receiver portion.

8. The system of claim 6, further including an additional device wirelessly connected to at least one of the foregrip and the first accessory.

9. The system of claim 8, wherein the additional device is located remote from the firearm.

10. The system of claim 8, wherein the one of the foregrip and the first assembly accessory transmits an emission to the additional device and the additional device activates upon receipt of the emission.

11. A method of controlling a firearm system, comprising:

(a) removably connecting a foregrip to a firearm; and (b) directing a control signal from the foregrip to an accessory of the firearm by manipulating a programmable button of the foregrip, wherein one of the foregrip and the accessory comprises a first portion of an inductive coupling device or an optical data link, and a rail of the firearm comprises a second portion of the inductive coupling device or the optical data link, the first portion being configured to mate with the second portion.

12. The method of claim 11, further comprising transmitting information from the accessory to an additional accessory of the firearm.

13. The method of claim 11, further comprising directing a wireless signal from the foregrip to an additional device of the firearm system located remote from the firearm.

14. The method of claim 11, further including directing power to a power source of the firearm by moving a loading bolt of the firearm.

15. A firearm system, comprising:

a foregrip removably mountable to a firearm, the foregrip having a programmable button controlling at least one of an accessory of the firearm and a component of the foregrip, wherein one of the foregrip and the accessory comprises a first portion of an inductive coupling device, and a rail of the firearm comprises a second portion of the inductive coupling device, the first portion configured to mate with the second portion.

16. The system of claim 15, wherein the first and second portions of the inductive coupling device comprise mating portions of an inductor/transmitter.

17. The system of claim 15, wherein the inductive coupling device transmits at least one of data and power between the firearm and the first accessory.

18. The system of claim 15, further including an additional device wirelessly connected to at least one of the foregrip and the accessory.

19. The system of claim 18, wherein the additional device is located remote from the firearm.

20. The system of claim 18, wherein the one of the foregrip and the accessory transmits an emission to the additional device and the additional device activates upon receipt of the emission.

21. A firearm system, comprising:

(a) a first accessory mounted to a firearm;

(b) a second accessory mounted to the firearm, the first and second accessories transmitting information between the accessories;

(c) a foregrip removably mounted to the firearm, the foregrip having a programmable button controllably connected to at least one of the first and second accessories; and (d) an inductive coupling device, a first portion of the inductive coupling device connected to the firearm and a second portion of the inductive coupling device connected to the first accessory, the first portion being configured to mate with the second portion.

22. The system of claim 21, wherein the inductive coupling device transmits at least one of data and power between the firearm and the first accessory.

23. The system of claim 21, wherein the first portion of the inductive coupling device comprises a transmitter portion and the second portion of the inductive coupling device comprises a receiver portion.

24. The system of claim 21, further including an additional device wirelessly connected to at least one of the foregrip and the first accessory.

25. The system of claim 24, wherein the additional device is located remote from the firearm.

26. The system of claim 24, wherein the one of the foregrip and the first accessory transmits an emission to the additional device and the additional device activates upon receipt of the emission.

* * * * *